US005505652A

United States Patent [19]

Click

[11] Patent Number: 5,505,652

[45] Date of Patent: Apr. 9, 1996

[54] DOLL HAVING MOVEABLE BODY PORTIONS

[76] Inventor: Roy M. Click, 7116 Grevilla Ave., St. Petersburg, Fla. 33707

[21] Appl. No.: 406,371

[22] Filed: Mar. 17, 1995

[51] Int. Cl.[6] ..... A63H 11/00

[52] U.S. Cl. ..... 446/353; 446/133; 446/275; 446/354

[58] Field of Search ..... 446/129, 133, 446/237, 275, 280, 287, 288, 330, 354, 272, 274, 289, 292, 352, 353, 358

[56] References Cited

U.S. PATENT DOCUMENTS

| | | | |
|---|---|---|---|
| 1,382,708 | 6/1921 | Zaiden . | |
| 1,576,789 | 3/1926 | Robertson | 446/354 |
| 1,827,774 | 10/1931 | Berger | 446/288 |
| 2,634,546 | 4/1953 | Carver | 446/288 |
| 2,758,415 | 8/1956 | Gibson | 446/287 |
| 3,564,763 | 2/1971 | Cleveland et al. . | |
| 3,568,361 | 3/1971 | Bart et al. . | |
| 4,083,143 | 4/1978 | Allen | 446/280 |

FOREIGN PATENT DOCUMENTS

| | | | |
|---|---|---|---|
| 465420 | 5/1937 | United Kingdom | 446/280 |

*Primary Examiner*—Mickeya Yu
*Assistant Examiner*—Jeffrey D. Carlson
*Attorney, Agent, or Firm*—James E. Larson; Herbert W. Larson

[57] ABSTRACT

A motorized mechanical doll for positioning within miniaturized vehicles capable of actuating body portions separate from any mechanical workings of the vehicle. The doll has a plurality of gears for engaging one another for turning a rotating head from side to side. There is a rotation means comprising a set of three magnets having the same polarity. The magnets are mounted to one of the gears and to a rotatable shaft for repelling one another and rotating the rotatable shaft which in turn communicates with the head portion. An alternate embodiment further includes a pivoting hand portion wherein a first end of a lever attaches to the pivoting hand and at a second end attaches to one of the gears slightly off-set from a center portion of the gear. Rotation of the gear causes the lever to move actuating the pivoting hand up and down.

20 Claims, 3 Drawing Sheets

DOLL HAVING MOVEABLE BODY PORTIONS

BACKGROUND OF THE INVENTION

1. Field of the Invention

This invention relates to dolls for use with models. More particularly, it relates to a doll for positioning within the driver seat of a remotely control motorized miniature vehicle.

2. Description of Prior Art

The operation of remotely controlled motorized miniature vehicles is an expanding hobby well known in the prior art. Types of remotely controlled vehicles include airplanes, cars, trucks, and boats. Hobbyist involved in the building, displaying, and operation of these vehicles attempt to replicate the vehicle to a life like model on the miniaturized scale. Tradeshows are held throughout the world for people interested in this hobby who display and market their creations.

The remote control operation of these vehicles is mostly performed by radio frequency devices employing a transmitter and receiver. The receiver is discretely mounted on the vehicle while the operator holds the transmitter and controls the vehicle. In an attempt to replicate these vehicles to a life like miniature model, hobbyists have begun positioning dolls within the driver seat of the vehicle to represent a miniature operator of the vehicle. At first, stationary dolls were positioned having life like human features. But, these type of dolls merely sit in the driver seat. Of course, when anyone is operating a vehicle, there is going to be movement in the body, arms, and head. Accordingly, hobbyists have attempted to provide means for moving body parts of their dolls while seated in the miniature vehicle.

The known moveable dolls have used other moving parts of the vehicle to communicate with the doll so that body parts can be moved as the vehicle moves. When the vehicle is not moving, the hobbyist is required to handle the vehicle and initiate a lever to move any of the body parts. Most of the known prior art dolls inserted with miniature vehicles merely turn their head slightly. This of course has not led to a life like replication of a miniature operator.

There exists a need for an improved doll for positioning within the driver seat of miniature vehicles which resembles a life like operator of the vehicle. The improved doll should be able to operate separately from the working mechanism of the remotely controlled vehicle permitting movement of the doll's body parts when the vehicle is not moving.

SUMMARY OF THE INVENTION

I have invented an improved doll for positioning within the driver seat of miniature vehicles. My doll permits movement of the doll's extremities separate from any movement or control of the miniature vehicle. More specifically to my preferred embodiment, my doll permits side to side life like movement of the head and up and down life like movement of the hand.

My doll has a frame for supporting a generally vertical rotatable shaft. A doll shoulder portion mounts on top of the frame and supports a rotatable doll head. Any rotation in the generally vertical shaft rotates the head respectively through a series of gears.

A horizontal shaft supports a second gear wheel having a first magnet mounted along an inner planar surface of the second gear wheel. Mounted in a spaced relation along the generally vertical shaft are a second and third magnet. The three magnets have the same polarity so that as the first magnet approaches either the second or third magnet, it repels the second or third magnet mounted to the generally vertical rotatable shaft effectively moving the generally vertical shaft which communicates with the rotatable doll head portion. A motor controlling a first gear wheel engaging the second gear wheel applies rotation to the second gear wheel. A third gear wheel mounted on top of the generally vertical rotatable shaft engages a fourth gear wheel communicating with the doll head portion. The third and fourth gear wheels act as a gear down means to slow down the rotation of the doll head portion providing a more life like head motion.

Alternate attachment of the present invention includes a pivoting hand portion mounted to an end portion of an outwardly extending arm. A pivot pin mounts the hand to the arm and a lever attached at opposed ends to the pivoting hand and the second gear permits up and down movement of the hand as the second gear rotates.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 3:
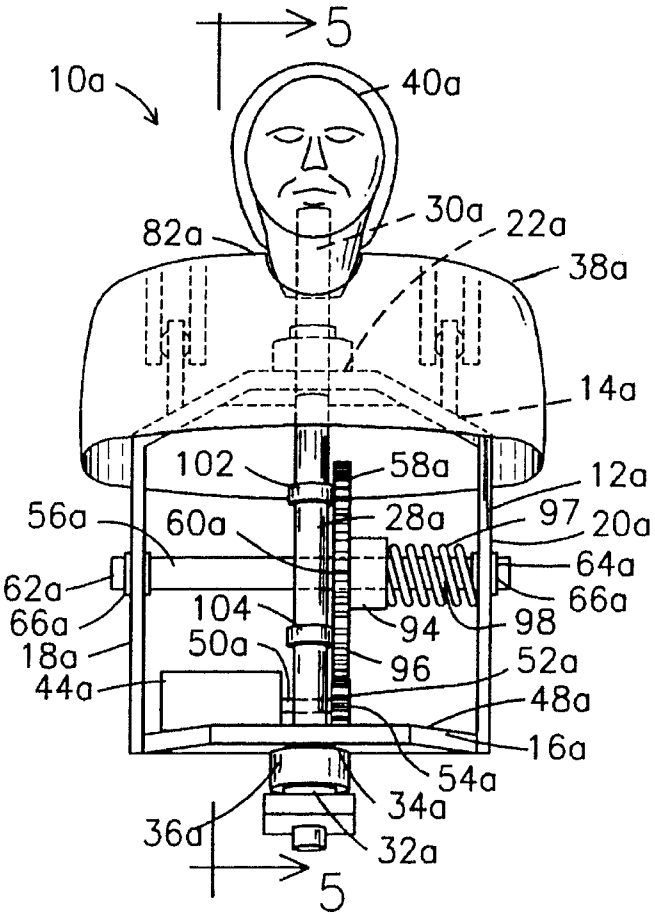
FIG. 3 is a front elevational view of an alternate embodiment of the present invention.

Throughout the following detailed description, the same reference numerals refer to the same elements in all figures.

Figure 1:
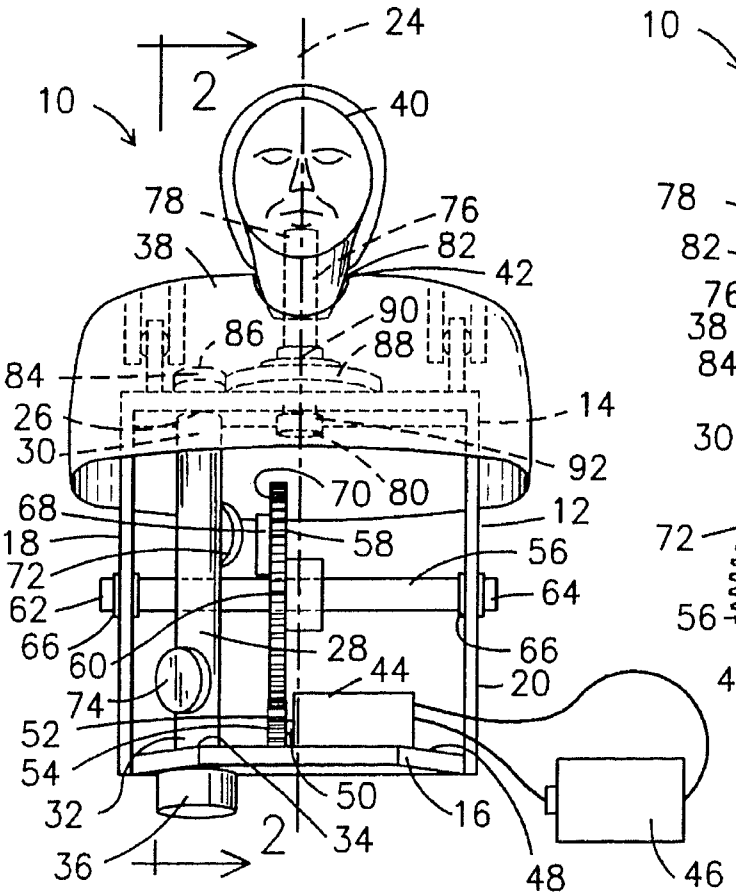
FIG. 1 is a front elevational view of the preferred embodiment of the present invention.

Referring to FIG. 1, a mechanical doll 10 for positioning in miniaturized vehicles is shown. Doll 10 has a frame 12 having opposed top and bottom walls 14 and 16 respectively and opposed left and right side walls 18 and 20 respectively. A central aperture 22 is formed in top wall 14 in axial alignment with a central axis 24 of doll 10. An off-set aperture 26 is additionally formed in top wall 14 slightly off-set from central aperture 22. In the preferred embodiment off-set aperture 26 is off-set to the left of central aperture 22 and frame 12 is generally rectangular in shape.

Referring to FIG. 1, a generally vertical rotatable shaft 28 having a top and bottom portion 30 and 32 respectively is supported by frame 12 whereby shaft top portion 30 extends through off-set aperture 26 and shaft bottom portion 32 extends through an opening 34 formed in frame bottom wall 16. A first locking nut 36 secures shaft bottom portion 32 to frame 12 through opening 34 while still permitting generally vertical rotatable shaft 28 to rotate.

Referring to FIG. 1, a shoulder portion 38 is supported by frame top wall 14. A rotatable head portion 40 is positioned upon shoulder portion 38 at an apex 42 of shoulder portion 38 so that head portion 40 is in axial alignment with central axis 24 of doll 10. Rotatable head portion 40 rotates from side to side generally in ninety degree turns from a center viewing position (illustrated in FIG. 1) responsive to the rotation of generally vertical rotatable shaft 28.

Referring to FIG. 1, an electric motor 44 is mounted to a top surface 48 of frame bottom wall 16 and electrically coupled to a battery source 46. Motor 44 has an outwardly extending rotatable shaft 50 supporting a first gear wheel 52 through a center portion 54 of first gear wheel 52. A horizontal rotatable shaft 56 supports a second gear wheel 58 through a center portion 60 of second gear wheel 58 such that first and second gear wheels 52 and 58 are permitted to engage each other. Opposed left and right ends 62 and 64 respectively of horizontal rotatable shaft 56 extend through opposed openings 66 in frame left and right side walls 18 and 20 and are secured permitting horizontal rotatable shaft 56 to rotate.

Figure 2:
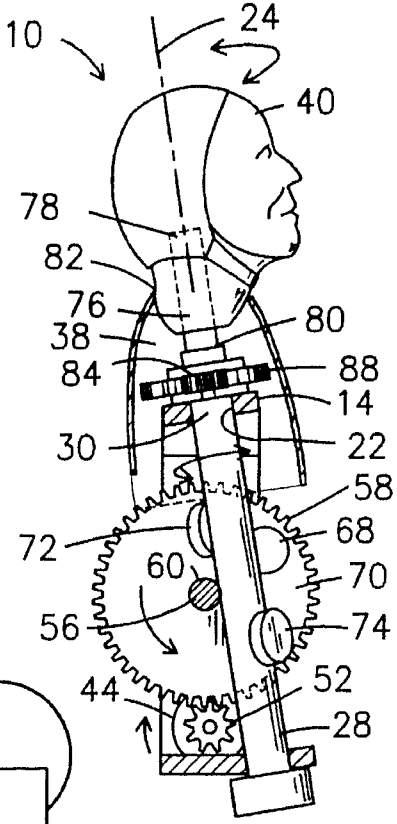
FIG. 2 is a cross-sectional view of the preferred embodiment of the present invention along lines 2—2 of FIG. 1.

Referring to FIG. 2, a first magnet 68 is mounted along a left side 70 of second gear wheel 58. A second and third magnet 72 and 74 respectively are mounted along generally vertical rotatable shaft 28 in an off-set and spaced relation. First, second and third magnets, 68, 72, and 74 all have the same polarity. As first magnet 68 passes by second magnet 72, generally at a one o'clock position relative to second gear wheel left side 70, first magnet 68 repels second magnet 72 rotating generally vertical rotatable shaft 28 in a first direction. As first magnet 68 passes by third magnet 74, generally at a four o'clock position relative to second gear wheel left side 70, first magnet 68 repels third magnet 74 rotating generally vertical rotatable shaft 28 in a second and opposed direction. In the preferred embodiment, second gear wheel 58 rotates in a counter-clockwise direction due to clockwise rotation of first gear wheel 52. The counter-clockwise rotation of second gear wheel 58 causes generally vertical rotatable shaft 28 to rotate in a counter-clockwise direction when first magnet 68 repels second magnet 72. The counter-clockwise rotation of second gear wheel 58 causes generally vertical rotatable shaft 28 to rotate in a clockwise rotation when first magnet 68 repels third magnet 74. The off-set and spaced positioning of second and third magnet 72 and 74 along generally vertical rotatable shaft 28 permits third magnet 74 to be ideally positioned for first magnet 68 to repel third magnet 74 after first magnet 68 has repelled second magnet 72 and for second magnet 72 to be ideally positioned for first magnet 68 to repel second magnet 72 after first magnet 68 has repelled third magnet 74. It is understood that the direction of rotation of first gear wheel 52 and the resulting relative direction of rotation of second gear wheel 58 and generally vertical rotatable shaft 28 are set forth to illustrate the rotating forces at work in doll 10 and the preferred direction of rotation at the time of invention. It is further understood that the relative direction of rotation can be reversed to accomplish the same results in the same manner.

Further to the preferred embodiment, as shown in FIGS. 1 and 2, a head supporting rotatable shaft 76 having a top and bottom portion 78 and 80 respectively is supported at frame top wall 14 wherein bottom portion 80 extends through central aperture 22 and is secured underneath frame top wall 14 by a second lucking nut 92 (FIG. 1). Top portion 78 of head supporting rotatable shaft 76 extends through an apex opening 82 formed in shoulder portion 38 permitting head portion 40 to be supported thereon. Head supporting rotatable shaft 76 is in axial alignment with central axis 24 of doll 10 and parallel to generally vertical rotatable shaft 28.

Further to FIGS. 1 and 2, a gear down means is provided to slow down the rotation of head portion 40 due to the speed of motor 44. A third gear wheel 84 is mounted on top portion 30 of generally vertical rotatable shaft 28 such that a center 86 (see FIG. 1) of third gear wheel 84 is in axial alignment with generally vertical rotatable shaft 28. A fourth gear wheel 88 is mounted through a center portion 90 (see FIG. 1) of fourth gear wheel 88 along head supporting rotatable shaft 76 intermediate top and bottom portions 78 and 80 of head supporting rotatable shaft 76 such that fourth gear wheel center portion 90 (see FIG. 1) is in axial alignment with central axis 24 of doll 10. Proximal positioning of third and fourth gear wheels 84 and 88 permits engagement therebetween.

Any rotation of generally vertical rotatable shaft 28 causes the same directional rotation of third gear wheel 84 which engages fourth gear wheel 88 thereby rotating head supporting rotatable shaft 76 which rotates head portion 40 directly. Therefore, counter-clockwise rotation of generally vertical rotatable shaft 28 rotates third gear wheel 84 counter-clockwise rotating fourth gear wheel 88 clockwise directly rotating head supporting rotatable shaft 76 and head portion 40 clockwise. And accordingly, clockwise rotation of generally vertical rotatable shaft 28 rotates third gear wheel 84 clockwise rotating fourth gear wheel 88 counter-clockwise directly rotating head supporting rotatable shaft 76 and head portion 40 counter-clockwise. The rotation of head portion 40 rotates generally ninety degrees in each direction off the center viewing position of doll 10 (represented in FIG. 1). Head portion 40 does not exceed a natural head rotation which is found in a live individual due to the relative positioning of second and third magnets 72 and 74 along generally vertical rotatable shaft 28 which cease being repelled by first magnet 68 after first magnet 68 has passed thereby respectively.

It is understood that the gear down means in the preferred embodiment is used to slow down the movement of head portion 40. Gear down means can be positioned above or below frame top wall 14. An alternate embodiment can be provided without the gear down means wherein off-set aperture 26 is not used and top portion 30 of generally vertical rotatable shaft 28 extends through central aperture 22 and supports head portion 40 thereon. Accordingly, any rotation of generally vertical rotatable shaft 28 would directly rotate head portion 40.

Referring to FIG. 3, an alternate embodiment of the present invention is provided as doll **10*a* having a shoulder portion 38*a* supported by a top wall 14*a* of a frame 12*a*. A generally vertical rotatable shaft 28*a* has a top and bottom portion 30*a* and 32*a* respectively, wherein top portion 30*a* extends through a central aperture 22*a* in top wall 14*a* and through an apex opening 82*a* of shoulder portion 38*a* supporting a rotatable head portion 40*a*. Bottom portion 32*a* of generally vertical rotatable shaft 28*a* extends through an opening 34*a* formed in a bottom wall 16*a* of frame 12*a*, and rotatable secured by a first locking nut 36*a***.

Referring to FIG. 3, an electric motor **44*a* coupled to a battery source 46*a* (FIG. 4) and mounted to a top surface 48*a* of frame bottom wall 16*a* has an outwardly extending rotatable shaft 50***a* supporting a first gear wheel 52*a* through a center portion 54*a* of first gear wheel 52*a*. A horizontal rotatable shaft 56*a* supports a second gear wheel 58*a* through a center portion 60*a* of second gear wheel 58*a* such that first and second gear wheel 52*a* and 58*a* can engage each other. Horizontal rotatable shaft 56*a* has opposed left and right ends 62*a* and 64*a* respectively extending through opposed openings 66*a* in opposed left and right side walls 18*a* and 20*a* of frame 12*a* and secured permitting horizontal rotatable shaft 56*a* to rotate. A spacer 94 is positioned juxtaposed a right side surface 96 of second gear wheel 58*a* and a spring 97 surrounds a right portion 98 of horizontal rotatable shaft 56*a* intermediate spacer 94 and frame right side wall 20*a* for retaining second gear wheel 58*a* in a fixed position along horizontal rotatable shaft 56*a*.

Figure 5:
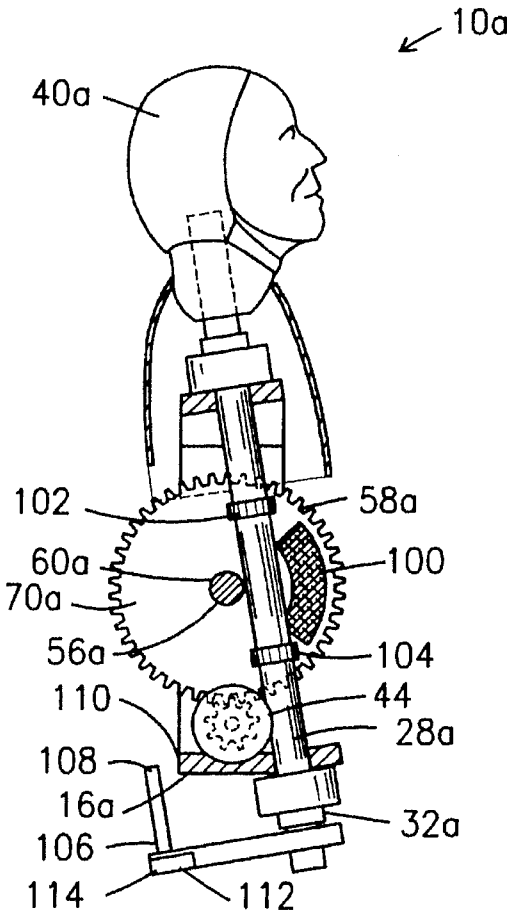
FIG. 5 is a cross-sectional view of the alternate embodiment along lines 5—5 of FIG. 3.
Figure 6:
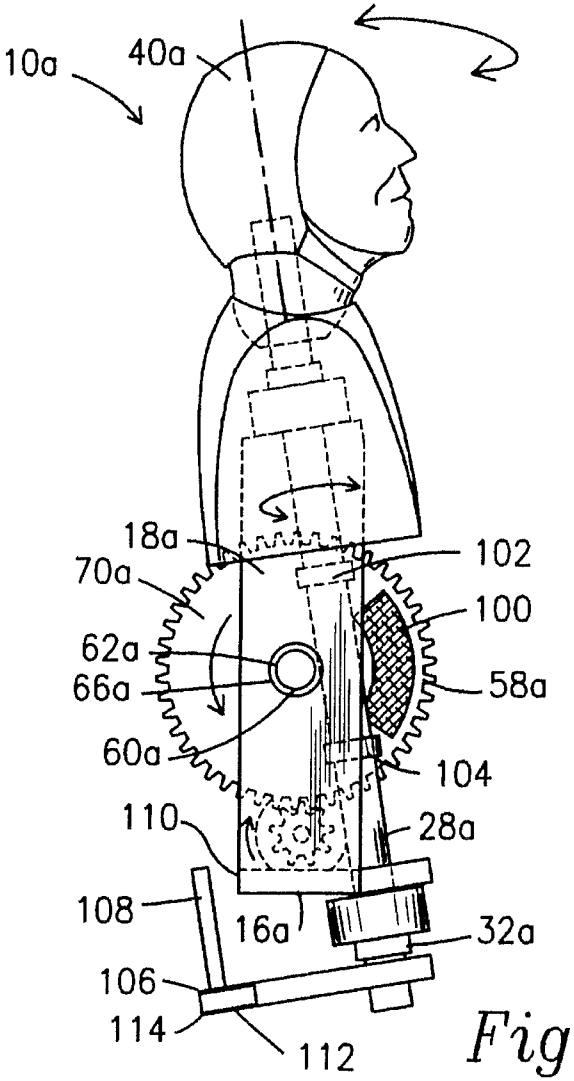
FIG. 6 is a left side elevational view of the alternate embodiment.

Referring to FIGS. 5 and 6, an abrasive strip 100 is mounted on a left side surface 70*a* of second gear wheel 58*a*. A first and second circular rubber washer 102 and 104 are positioned along generally vertical rotatable shaft 28*a* such that abrasive strip 100 can make contact therewith for causing generally vertical rotatable shaft 28*a* to rotate. As second gear wheel 58*a* rotates in a counter-clockwise direction, abrasive strip 100 passes first rubber washer 102 generally at a one o'clock position relative to left side surface 70*a* of second gear wheel 58*a*, making contact therewith and forcing generally vertical rotatable shaft 28*a* in a counter-clockwise direction rotating head portion 40*a* in a counter-clockwise direction. As second gear wheel 58*a* continues to rotate in the counter-clockwise direction, abrasive strip 100 passes second rubber washer 104 generally at a four o'clock position relative to left side surface 70*a* of second gear wheel 58*a*, making contact therewith and forcing generally vertical rotatable shaft 28*a* in a clockwise direction rotating head portion 40*a* in a clockwise direction.

Referring to FIGS. 5 and 6, a stop mechanism 106 is mounted on bottom portion 32*a* of generally vertical rotatable shaft 28*a*. Stop mechanism 106 has an upwardly projecting member 108 which strikes a rear surface 110 of frame bottom wall 16*a* as generally vertical rotatable shaft 28*a* rotates prohibiting head portion 40*a* from rotating any further than ninety degrees off a center viewing position (illustrated in FIG. 3). A lead shot 112 is mounted on an end portion 114 of stop mechanism 106 directly below upwardly projecting member 108 for pulling stop mechanism 106 back to a resting state by forces of gravity, re-positioning head portion 40*a* in its center viewing position. Lead shot 112 is permitted to pull stop mechanism 106 back to a resting state directly after abrasive strip 100 ceases contact with first or second rubber washer 102 and 104.

Figure 7:
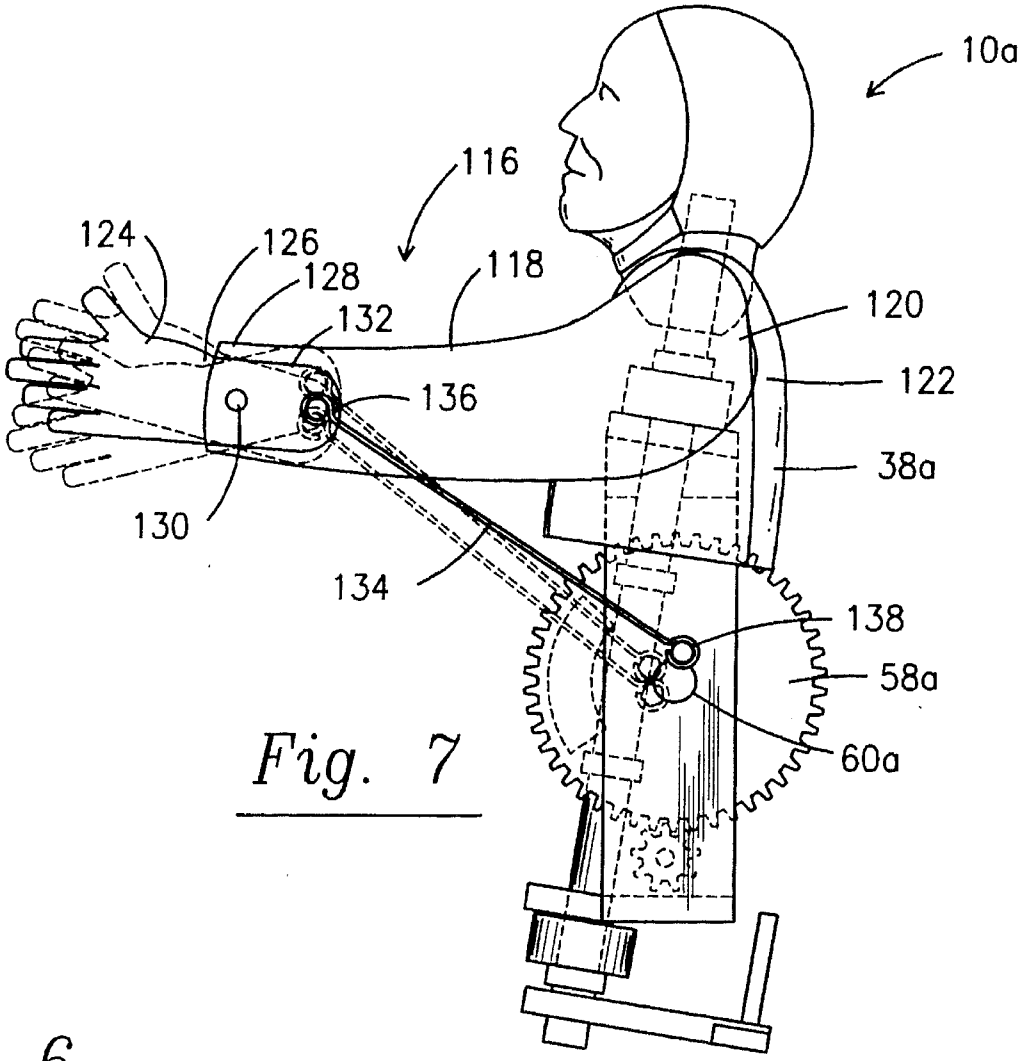
FIG. 7 is a right side elevational view of the alternate embodiment including a pivoting hand portion.

Referring to FIG. 7, a moveable hand mechanism 116 is shown as an alternate attachment to either doll 10 or 10*a*. In FIG. 7, moveable hand mechanism 116 is shown attached to alternate doll 10*a*, although it can be attached to preferred doll 10 in the same manner. Moveable hand mechanism 116 has an outwardly extending arm portion 118 mounted at a first end 120 of arm portion 118 along a side 122 of shoulder portion 38*a*. A pivoting hand portion 124 is mounted at a wrist portion 126 to a second end 128 of arm portion 118 by a pivot pin 130 and has a proximal end 132 relative to shoulder portion side 122 . A lever 134 has a first end 136 attached to hand proximal end 132 and a second end 138 attached to second gear wheel 58*a* slightly off-set from second gear wheel center portion 60*a* such that rotation of second gear actuates pivoting hand portion 124 up and down.

Figure 4:
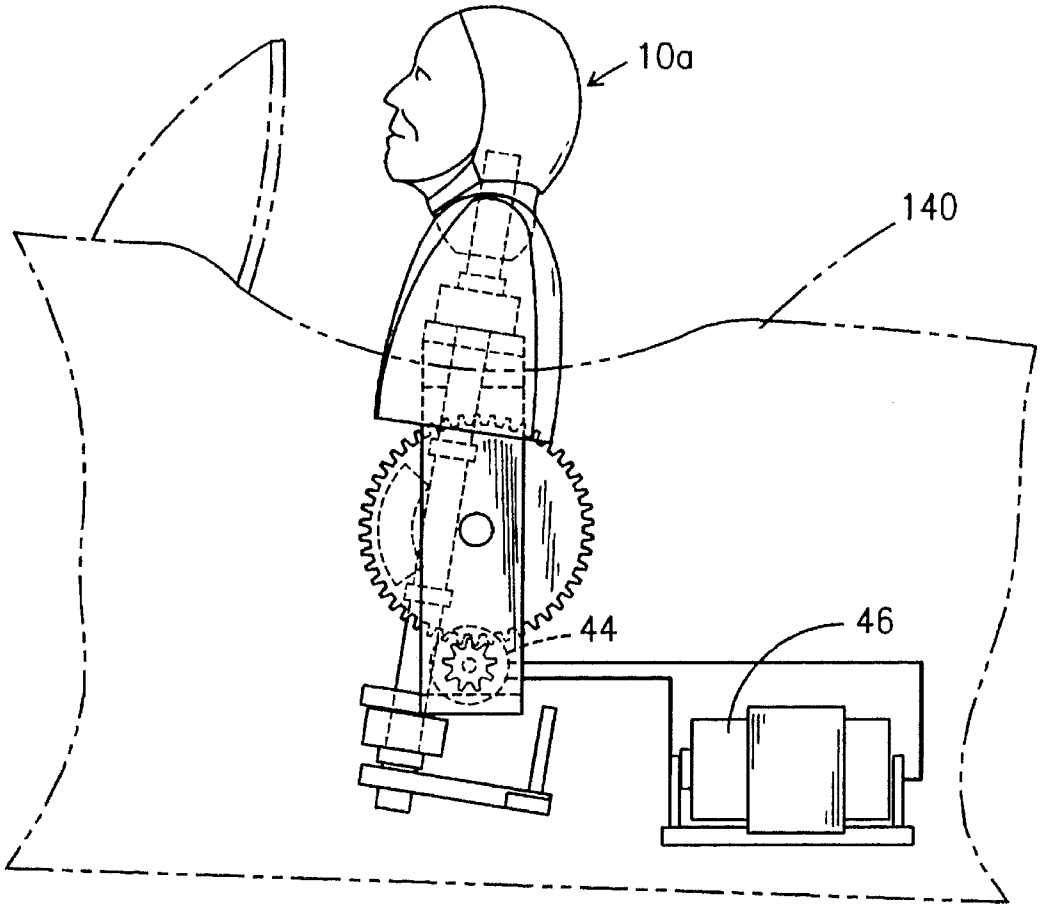
FIG. 4 is a right side elevational view of the alternate embodiment of the present invention depicting the invention positioned within a miniaturized vehicle illustrated by the broken lines.

As shown in FIG. 4, doll 10*a* is positioned within a cockpit 140 of a miniaturized airplane, the preferred vehicle in which to positioned either doll 10 or doll 10*a*. Preferred doll 10 and alternate doll 10*a* can be positioned in other miniaturized vehicles used by hobbyists such as boats, cars, and the like.

Equivalent elements can be substituted for the ones set forth above to achieve the same results in the same manner.

Having thus described the invention what is claimed and desired to be secured by Letters Patent is:

1. A motorized mechanical doll capable of actuating body portions, the doll positioned within a miniaturized vehicle, the motorized mechanics of the doll separate from any mechanical workings of the miniaturized vehicle, the motorized mechanical doll comprising, a frame having opposed top and bottom walls, opposed left and right side walls, and an aperture formed in the top wall, a generally vertical rotatable shaft supported at a bottom portion by the frame bottom wall and having a top portion extending through the frame top wall aperture, a shoulder portion supported by the frame top wall, the shoulder portion having an apex, a rotatable head portion positioned upon the shoulder portion apex, the rotatable head portion actuated by the rotation of the generally vertical shaft, a first and second gear in communication with each other, a horizontal rotatable shaft supported by the frame opposed left and right side walls, the horizontal rotatable shaft supporting the second gear through a center portion of the second gear, an electric motor mounted to the frame and having an outwardly extending rotatable shaft supporting the first gear through a center portion of the first gear, a battery source electrically coupled to the electric motor providing power thereto, the battery source positioned within the vehicle, and first and second rotation means mounted to the second gear and to the generally vertical shaft respectively, communication between the first and second rotation means providing rotation to the generally vertical rotatable shaft.

2. The motorized mechanical doll according to claim 1, wherein the frame is generally rectangular in shape.

3. The motorized mechanical doll according to claim 1, wherein the generally vertical rotatable shaft bottom portion extends through an opening formed in the frame bottom wall and is secured by a first locking nut permitting the generally vertical rotatable shaft to rotate.

4. The motorized mechanical doll according to claim 1, wherein the battery source is mounted proximal to the doll frame.

5. The motorized mechanical doll according to claim 1, wherein the first and second rotation means is a plurality of magnets having the same polarity.

6. The motorized mechanical doll according to claim 5, wherein the first rotation means is a first magnet mounted on a left side surface of the second gear and the second rotation means is a second and third magnet mounted along the generally vertical rotatable shaft in an off-set spaced relation such that the first magnet passes by the second magnet generally at a one o'clock position and the third magnet generally at a four o'clock position relative to the left side surface of the second gear as the second gear rotates.

7. The motorized mechanical doll according to claim 6, wherein as the second gear rotates, the first magnet passes by the second magnet repelling the second magnet and rotating the generally vertical rotatable shaft in a first direction, and wherein thereafter the first magnet passes by the third magnet repelling the third magnet and rotating the generally vertical rotatable shaft in a second and opposed direction.

8. The motorized mechanical doll according to claim 1, further comprising, a central aperture formed in the frame top wall along a central axis of the doll, the generally vertical rotatable shaft offset from the central axis of the doll, a head supporting rotatable shaft supported by the frame top wall parallel to the generally vertical rotatable shaft, the head supporting rotatable shaft having a top and bottom portion, the head supporting rotatable shaft top portion supporting the doll head portion, the head supporting rotatable shaft bottom portion extending through the central aperture formed in the frame top wall and secured by a second locking nut beneath the frame top wall, and gear down means for slowing down the rotation of the doll head portion, the gear down means positioned mounted proximal to the doll head portion.

9. The motorized mechanical doll according to claim 8, wherein the gear down means is a third and fourth gear in communication with each other.

10. The motorized mechanical doll according to claim 9, wherein the third gear is mounted along the generally vertical rotatable shaft proximal to the generally vertical rotatable shaft top portion, a center portion of the third gear in axial alignment with the generally vertical rotatable shaft, and wherein the fourth gear is mounted along the head supporting rotatable shaft through a center portion of the fourth gear in axial alignment with the central axis intermediate the head supporting rotatable shaft top and bottom portions.

11. The motorized mechanical doll according to claim 1, further comprising, an outwardly extending arm portion mounted at a first end along a side of the shoulder portion, a pivoting hand portion mounted at a wrist portion to a second end of the outwardly extending arm portion by a pivot pin, the pivoting hand portion having a proximal end relative to the side of the shoulder portion, and a lever having a first end attached to the hand portion proximal end and a second end attached to the second gear slightly off-set from the second gear center portion such that rotation of the second gear actuates the pivoting hand portion up and down.

12. A motorized mechanical doll capable of actuating body portions, the doll positioned within a miniaturized vehicle, the motorized mechanics of the doll separate from any mechanical workings of the miniaturized vehicle, the motorized mechanical doll comprising, a central axis, a frame having opposed top and bottom walls, opposed left and right side walls, and an off-set aperture formed in the top wall, a central aperture formed in the frame top wall in axial alignment with the doll central axis, a generally vertical rotatable shaft having a top portion extending through the frame top wall off-set aperture and a bottom portion extending through an opening formed in the frame bottom wall, the bottom portion secured by a first locking nut permitting the generally rotatable shaft to rotate, a shoulder portion supported by the frame top wall, the shoulder portion having an apex, a rotatable head portion positioned upon the shoulder portion apex, the rotatable head portion actuated by the rotation of the generally vertical shaft, a head supporting rotatable shaft having a top portion supporting the doll head portion and a bottom portion extending through the central aperture formed in the frame top wall and secured by a second locking nut beneath the frame top wall, the head supporting rotatable shaft in axial alignment with the doll central axis and parallel to the generally vertical rotatable shaft, a first and second gear in communication with each other, a horizontal rotatable shaft supported by the frame opposed left and right side walls, the horizontal rotatable shaft supporting the second gear through a center portion of the second gear, an electric motor mounted to the frame and having an outwardly extending rotatable shaft supporting the first gear through a center portion of the first gear, a battery source electrically coupled to the electric motor providing power thereto, the battery source positioned within the vehicle, gear down means for slowing down and transferring the rotational motion of the generally vertical rotatable shaft to the head supporting rotatable shaft, the gear down means positioned proximal to the doll head portion, and first and second rotation means mounted to the second gear and to the generally vertical shaft respectively, communication between the first and second rotation means providing rotation to the generally vertical rotatable shaft.

13. The motorized mechanical doll according to claim 12, further comprising, an outwardly extending arm portion mounted at a first end along a side of the shoulder portion, a pivoting hand portion mounted at a wrist portion to a second end of the outwardly extending arm portion by a pivot pin, the pivoting hand portion having a proximal end relative to the side of the shoulder portion, and a lever having a first end attached to the hand portion proximal end and a second end attached to the second gear slightly off-set from the second gear center portion such that rotation of the second gear actuates the pivoting hand portion up and down.

14. The motorized mechanical doll according to claim 12, wherein the gear down means is a third and fourth gear in communication with each other, the third gear mounted along the generally vertical rotatable shaft proximal to the generally vertical rotatable shaft top portion, a center portion of the third gear in axial alignment with the generally vertical rotatable shaft, and the fourth gear mounted along the head supporting rotatable shaft through a center portion of the fourth gear in axial alignment with the central axis intermediate the head supporting rotatable shaft top and bottom portions.

15. The motorized mechanical doll according to claim 12, wherein the first rotation means is a first magnet and the second rotation means is a second and third magnet, the first magnet mounted on a left side surface of the second gear, the second and third magnets mounted along the generally vertical rotatable shaft in an off-set spaced relation such that the first magnet passes by the second magnet generally at a one o'clock position and the third magnet generally at a four o'clock position relative to the left side surface of the second gear as the second gear rotates.

16. The motorized mechanical doll according to claim 15, wherein as the second gear rotates, the first magnet passes by the second magnet repelling the second magnet and rotating the generally vertical rotatable shaft in a first direction, and wherein thereafter the first magnet passes by the third magnet repelling the third magnet and rotating the generally vertical rotatable shaft in a second and opposed direction.

17. A motorized mechanical doll capable of actuating body portions, the doll positioned within a miniaturized vehicle, the motorized mechanics of the doll separate from any mechanical workings of the miniaturized vehicle, the motorized mechanical doll comprising, a central axis, a frame having opposed top and bottom walls, opposed left and right side walls, and a central aperture formed in the top wall in axial alignment with the central axis, a shoulder portion supported by the frame top wall, the shoulder portion having an apex, a generally vertical rotatable shaft having a top and bottom portion, the top portion extending through the frame top wall central aperture and the shoulder portion apex, the bottom portion extending through an opening formed in the frame bottom wall and secured by a locking nut permitting the generally rotatable shaft to rotate, a rotatable head portion positioned upon the shoulder portion apex and supported by the top portion of the generally vertical rotatable shaft, the rotatable head portion actuated by the rotation of the generally vertical shaft, a first and second gear in communication with each other, a horizontal rotatable shaft supported by the frame opposed left and right side walls, the horizontal rotatable shaft supporting the second gear through a center portion of the second gear, a spacer positioned juxtaposed a right side surface of the second gear along the horizontal rotatable shaft, a spring surrounding a right portion of the horizontal rotatable shaft intermediate the spacer and the frame right wall, the spring and spacer retaining the second gear in a fixed position along the horizontal rotatable shaft, an electric motor mounted to the frame and having an outwardly extending rotatable shaft supporting the first gear through a center portion of the first gear, a battery source electrically coupled to the electric motor providing power thereto, the battery source positioned within the vehicle, first and second rotation means mounted to the second gear and to the generally vertical shaft respectively, communication between the first and second rotation means providing rotation to the generally vertical rotatable shaft.

18. The motorized mechanical doll according to claim 17, further comprising, an outwardly extending arm portion mounted at a first end along a side of the shoulder portion, a pivoting hand portion mounted at a wrist portion to a second end of the outwardly extending arm portion by a pivot pin, the pivoting hand portion having a proximal end relative to the side of the shoulder portion, and a lever having a first end attached to the hand portion proximal end and a second end attached to the second gear slightly off-set from the second gear center portion such that rotation of the second gear actuates the pivoting hand portion up and down.

19. The motorized mechanical doll according to claim 17, wherein the first rotation means is an abrasive strip mounted along a left side surface of the second gear and the second rotation means is a first and second rubber washer positioned in a spaced relation on the generally vertical rotatable shaft.

20. The motorized mechanical doll according to claim 19, wherein as the second gear rotates, the abrasive strip makes contact with the first rubber washer at a one o'clock position relative to the left side surface of the second gear rotating the generally vertical rotatable shaft in a first direction, and wherein thereafter the abrasive strip makes contact with the second rubber washer at a four o'clock position relative to the left side surface of the second gear rotating the generally vertical rotatable shaft in a second and opposed direction.

* * * * *